US006830244B2

(12) United States Patent
Komatsu

(10) Patent No.: US 6,830,244 B2
(45) Date of Patent: Dec. 14, 2004

(54) SHEET FEEDING APPARATUS

(75) Inventor: Ryuta Komatsu, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/237,869

(22) Filed: Sep. 10, 2002

(65) Prior Publication Data

US 2003/0047862 A1 Mar. 13, 2003

(30) Foreign Application Priority Data

Sep. 11, 2001 (JP) ..... 2001-274958
Sep. 11, 2001 (JP) ..... 2001-274973

(51) Int. Cl.[7] ..... B65J 5/00
(52) U.S. Cl. ..... 271/10.01; 271/10.09; 271/10.11
(58) Field of Search ..... 271/10.09, 10.11, 271/121, 10.01, 10.06, 10.08

(56) References Cited

U.S. PATENT DOCUMENTS 5,083,766 A 1/1992 Osawa
5,984,298 A * 11/1999 Wada et al. ..... 271/121
6,206,368 B1 * 3/2001 Kobayashi et al. ..... 271/273
6,279,893 B1 * 8/2001 Ohkawa et al. ..... 271/10.12
6,550,759 B2 * 4/2003 Kotaka et al. ..... 271/10.11
RE38,212 E * 8/2003 Westcott et al. ..... 271/10.03

FOREIGN PATENT DOCUMENTS

JP 2504655 4/1996

* cited by examiner

*Primary Examiner*—David H. Bollinger
(74) *Attorney, Agent, or Firm*—Manabu Kanesaka

(57) ABSTRACT

A sheet feeding apparatus is formed of a sheet supply device for feeding sheets drawn out from a sheet supply tray, a separating device for separating the sheets drawn out from the sheet supply tray, a transport device for transporting the sheets downstream, a transport path formed between the sheet supply device and the transport device and having first and second transport paths, and follower rotating bodies. The first transport path guides sheets fed from the sheets supply device in a substantially tangential direction of the nipping point, and the second transport path guides sheets from the first transport path toward the transport device after bending from the substantially tangential direction to the separating device. The follow rotating bodies are protrudingly arranged from the separating device in the transport path, between a curved portion extending from the first transport path to the second transport path and the nipping point.

10 Claims, 10 Drawing Sheets

SHEET FEEDING APPARATUS

BACKGROUND OF THE INVENTION AND RELATED ART STATEMENT

The present invention relates to a sheet feeding apparatus for feeding sheets in an electronic copy machine, facsimile or printer.

Many types of conventional sheet feeding apparatus are well known, such as the structure shown in FIG. 10 (see Japanese Utility Model No. 2,504,655). These are composed of the sheet supply tray 60 for stacking sheets, the pickup roller 61 for drawing out the lowermost sheet stacked on the sheet supply tray 60 by touching it, the sheet feeding roller 62 and the separation pad 63 arranged downstream of the pickup roller 61, the transport path 64, immediately downstream of the sheet feeding roller 62 that curves abruptly downward, the follower roller 66 arranged at the curved portion 65 in the aforementioned transport path 64, the transport rollers 67*a* and 67*b* arranged immediately downstream of the aforementioned follower roller 66 also acting as to resist. The aforementioned separation pad 63 resiliently presses the sheet feeding roller 62 from above to separate sheets fed by the pickup roller 61 to a single sheet therebetween with the sheet feeding roller 62. Separated sheet is fed into the inverting space 68 and the straight guide portion 69 by the sheet feeding roller 62. After being nipped by the transport rollers 67*a* and 67*b*, it is transported to the platen 70 by the transport rollers 67*a* and 67*b*. When the sheet is transported by the transport rollers 67*a* and 67*b* at the upstream of the transport path 64, the sheet is nipped by the sheet feeding roller 62 and the separation pad 63. For that reason, a large transporting resistance force is applied to the sheet being transported, but transporting resistance force is alleviated by the follower roller 66 which is arranged in the aforementioned curved portion 65 to prevent scratching of the images on the sheets or damaging of the reading images.

However, because the aforementioned sheet feeding apparatus is the type that supplies sheets from the lowermost of sheets stacked on the sheet supply tray 60, the final page of a plurality of originals is supplied, thereby leaving the first page for last, causing the problem of making it difficult to grasp the status of feeding originals. Thus, the aforementioned sheet feeding apparatus requires a configuration that arranges the sheet feeding roller 62 in an upward position and the separation pad 63 to resiliently press the sheet feeding roller 62 from below to respond to demands for a top supply type apparatus that supplies sheets beginning with the uppermost sheet of a plurality of sheets stacked on the sheet supply tray 60.

However, if the separation pad 63 is arranged below the sheet feeding roller 62, the aforementioned transport resistance force works downward to the separation pad and is directly applied, making the pressing force against the sheet feeding roller 62 inappropriate, and the separation pad itself hangs downward. In such a case, the function to separate subsequent sheets already drawn by the pickup roller 61 becomes ruined and causes the phenomenon of subsequent sheets being fed along with the sheet in transport.

Thus, an object of the present invention is to provide a sheet feeding apparatus that prevents sheet separation problems and double feedings of sheets.

SUMMARY OF THE INVENTION

In order to attain the aforementioned objective, the sheet feeding apparatus according to a first aspect of the present invention comprises sheet supply means for feeding sheets drawn out from a sheet supply tray, separating means for separating sheets drawn out from the sheet supply tray separatingly pressing against the aforementioned sheet supply means, therebetween the sheet supply means, transport means for transporting downstream sheets nipped by the aforementioned sheet supply means and the aforementioned separating means, a first transport path for guiding sheets fed from the aforementioned sheets supply means in a substantially tangential direction of the nipping point of the aforementioned sheet supply means and the aforementioned separating means, formed between the aforementioned sheet supply means and the aforementioned transport means, a transport path comprising a second transport path for guiding sheets from the aforementioned first transport path toward the aforementioned transport means after curving from the aforementioned substantially tangential direction to the aforementioned separating means, and follower rotating bodies protrudingly arranged from the aforementioned separating means in the aforementioned transport path, between the curving portion traveling from the aforementioned first transport path to the aforementioned second transport path and the aforementioned nipping point.

According to the invention so configured, by establishing a curved portion in substantially a straight line with the nipping point of the aforementioned sheet supply means and the aforementioned separating means and establishing a follower rotating bodies in the transport path between the aforementioned curved portion and the aforementioned nipping point, the follower roller receives the transport resistance force of the originals and alleviates the load on the sheet at the aforementioned curved portion, and no pulling force is generated in the separating means in the direction to separate from the sheet supply means. For that reason, there is no variation in the pressing force of the separating means, so the invention securely prevents separation problems caused by the separation means and double sheet feeds.

It is preferable to establish the aforementioned curved portion near the downstream side of the aforementioned nipping point. Doing so shortens the transporting distance from the aforementioned nipping point to the transport means thereby enabling a more compact overall transport path.

Also, it is preferable to establish in the second transport path a second curved portion that curves sheets to the transport path and in the aforementioned curved portion, to arrange a second follower rotating bodies that protrudes from the inner side of the aforementioned curved portion into the transport path. Doing so enables feeding the sheets in the appropriate direction toward the transport means and alleviates the transport force applied to the sheet.

Also, according to the present invention, it is preferable that at least one of the aforementioned sheet supply means, the follower rotating bodies and the transport means is composed of one or more rollers, and that at least one follower roller and transport roller be arranged from substantially the center of the width direction of the sheets supply roller in a straight line along the sheet transport direction. In that way, by arranging a first follower roller that alleviates the transport resistance force in a straight line tying the center position of the sheet feeding roller and the transport roller, and a second follower roller, the load applied to sheets in the aforementioned curved portion when the transport roller is transporting sheets is effectively alleviated.

It is also preferable to use the substantial center of the width direction of the aforementioned sheet feeding roller as the apex and to arrange the aforementioned follower roller on both sides of a triangle shape tying the apex and the both ends of the width direction of the transport rollers. Such a roller array is an even more effective way to alleviate the load applied to sheets in the aforementioned curved portion when sheets are transported by the transport rollers.

DETAILED DESCRIPTION OF THE PREFERRED EMBODIMENTS

Figure 1:
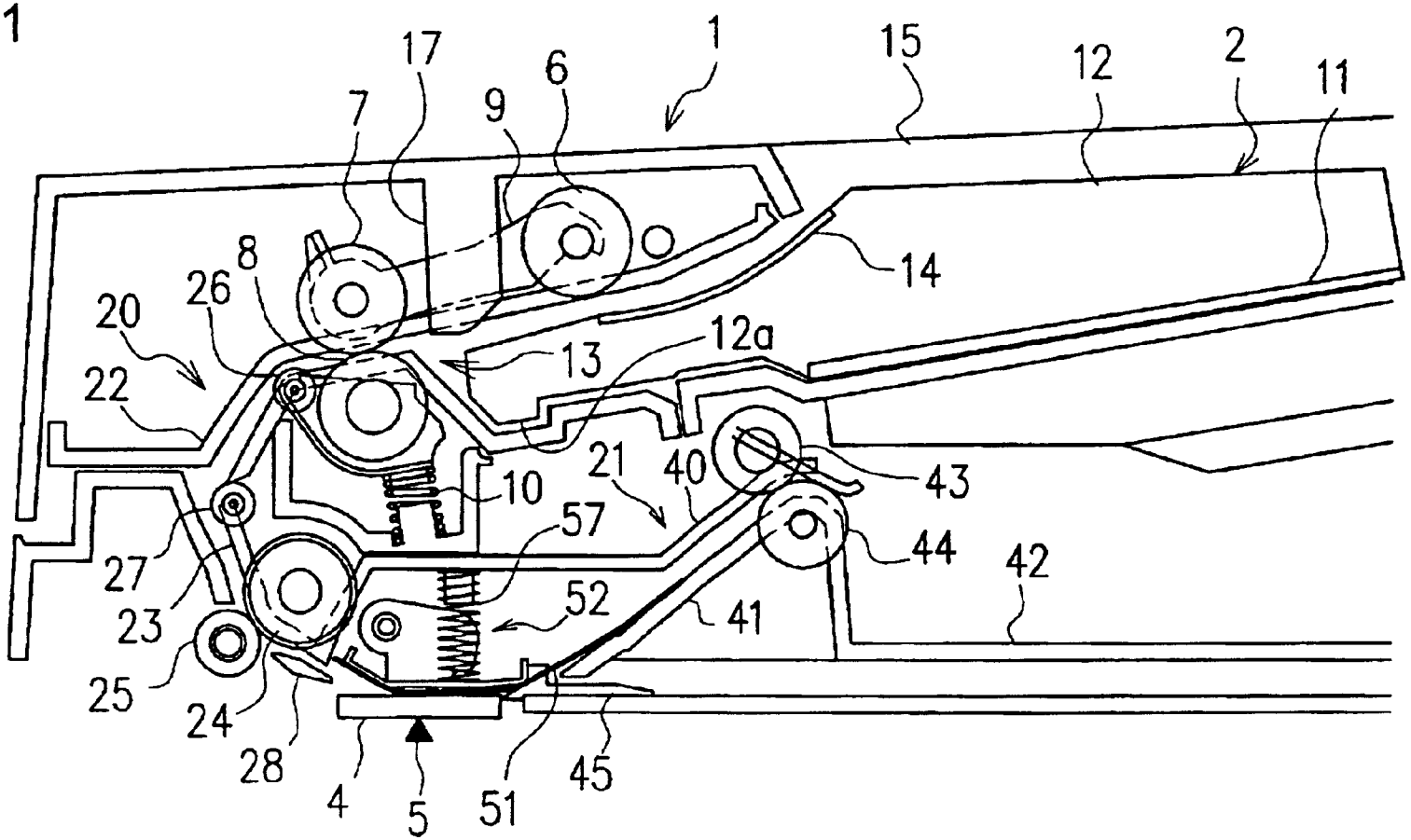
FIG. 1 is a schematic view of an internal configuration of a sheet feeding apparatus according to the present invention.
Figure 2:
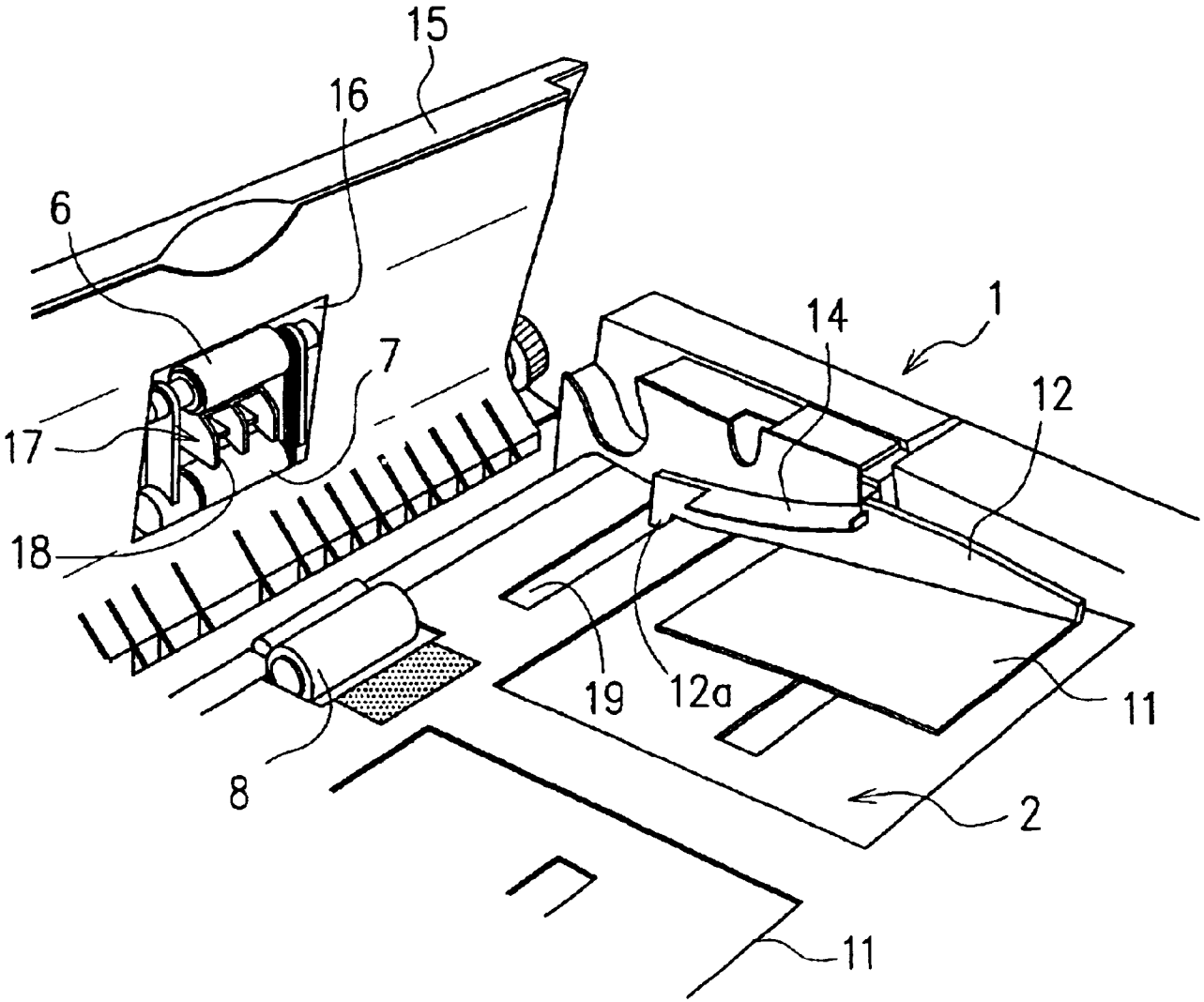
FIG. 2 is a perspective view of a cover above the sheet supply tray open.
Figure 3:
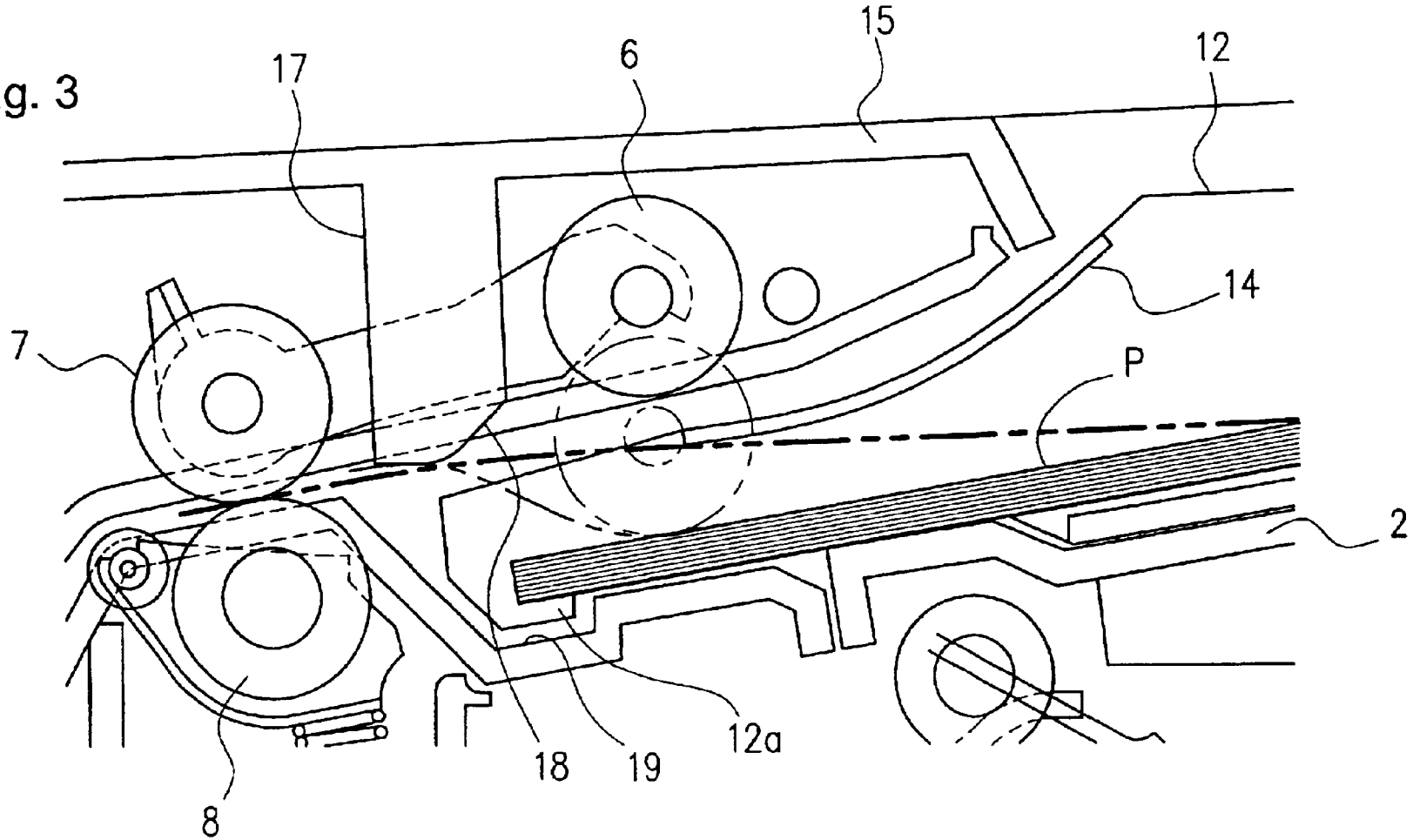
FIG. 3 is an enlarged view showing the sheet feeding apparatus sheet feeding portion draw out configuration.
Figure 4:
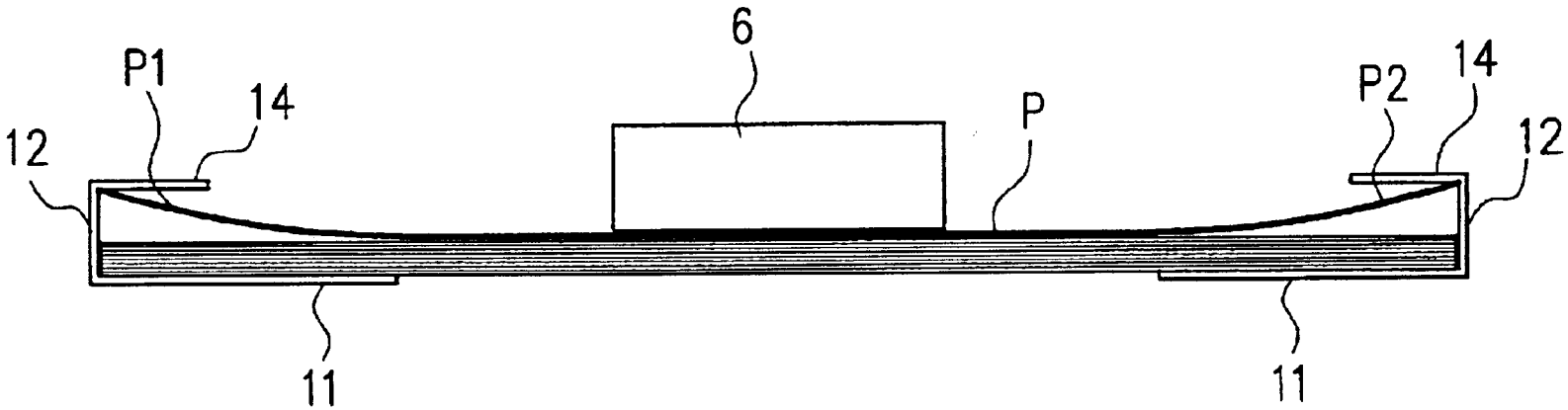
FIG. 4 is a conceptual view showing restrictions on both sides of the originals when drawing originals out from the sheet supply tray.
Figure 5:
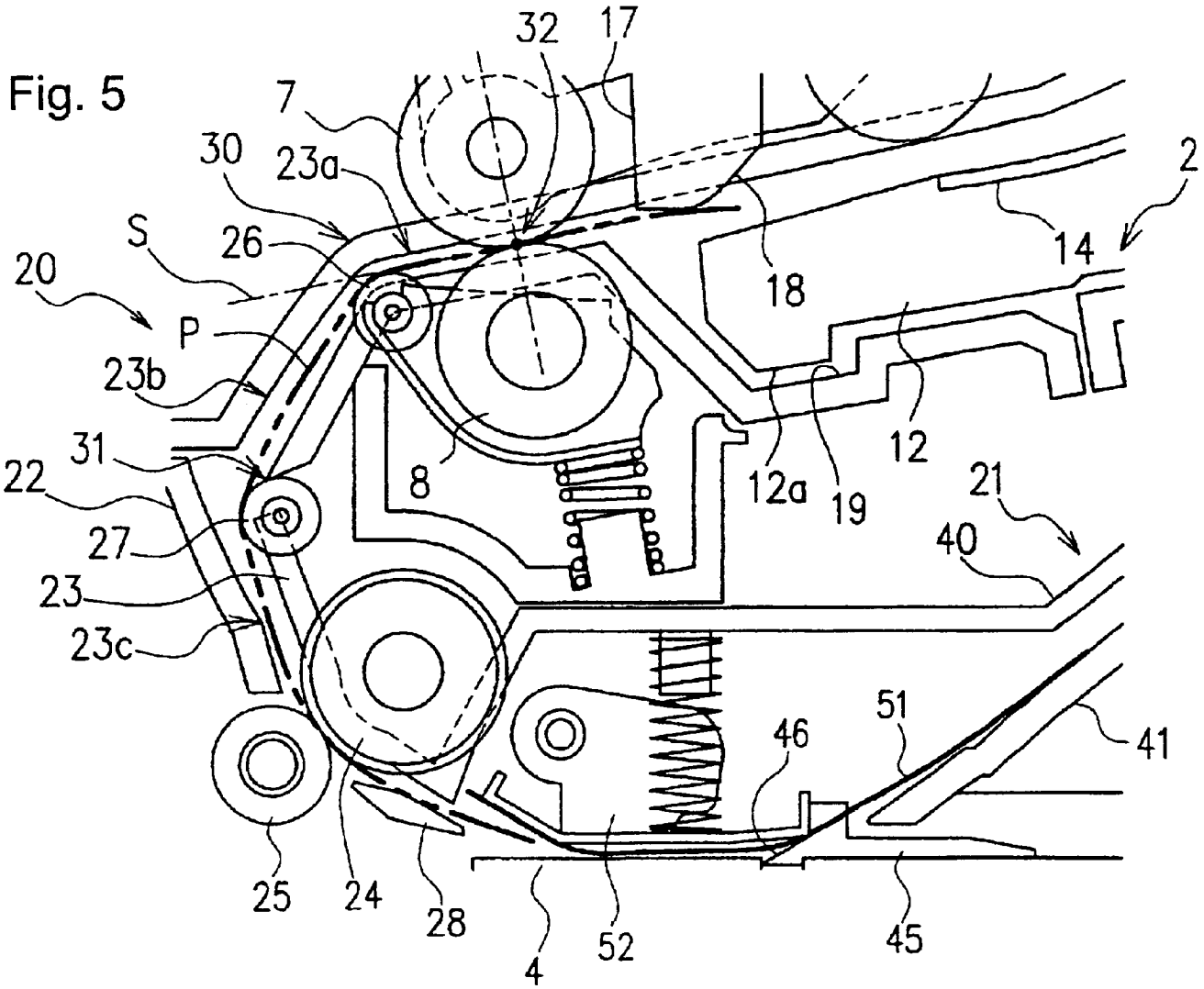
FIG. 5 is an enlarged view of an essential configuration of the sheet supply portion of the sheet feeding apparatus according to the present invention.
Figure 6:
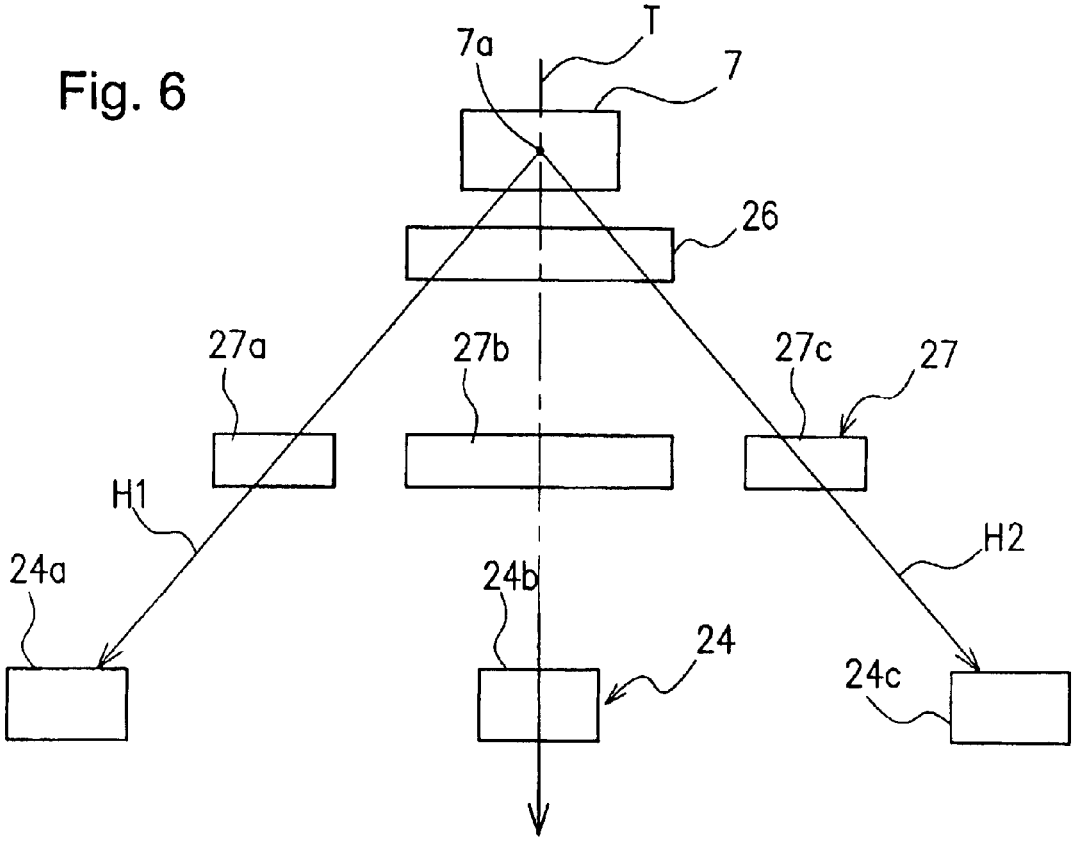
FIG. 6 is a conceptual view of arrangement positions of each roller composing the transport path according to the present invention.
Figure 7:
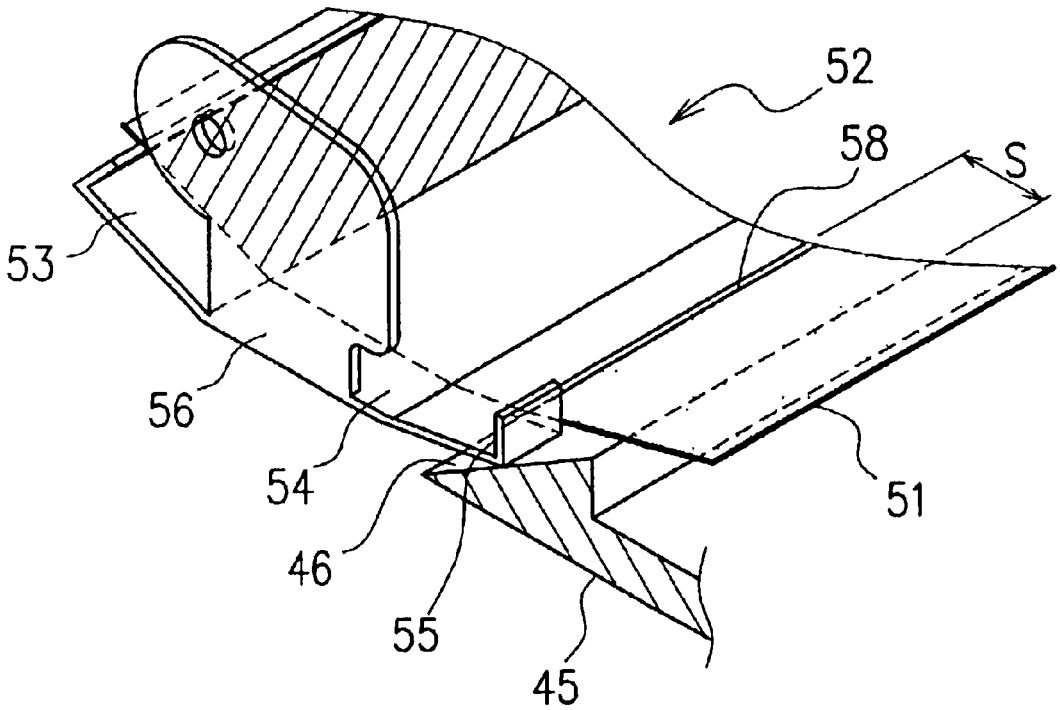
FIG. 7 is a perspective view showing a first embodiment of a restricting member in the original reading position.

The following is a detailed description of the preferred embodiments of the original sheet feeding apparatus according to the present invention based upon the drawings provided. FIG. 1 is a schematic view of the internal configuration of the first embodiment of the sheet feeding apparatus mounted on an image reading apparatus, FIG. 2 is a perspective view of the cover above the tray on the original sheet feeding apparatus open. Also, FIG. 3 is an enlarged view showing the sheet feeding apparatus sheet feeding portion draw out configuration of the original sheet feeding apparatus; FIG. 4 is a conceptual view showing restrictions on both sides of the originals when drawing originals out from the sheet supply tray. Furthermore, FIG. 5 is an enlarged view of the essential configuration of the sheet supply portion of the original sheet feeding apparatus according to the present invention; FIG. 6 is a conceptual view of the arrangement positions of each roller composing the transport path. Also, FIG. 7 is a perspective view showing the first embodiment of the restricting member in the original reading position.

As shown in FIG. 1, the original sheet feeding apparatus 1 according to the preferred embodiment is provided an original sheet feeding portion that separates and supplies originals one at a time, as the sheets stacked on the sheet supply tray 2, a transport portion to feed supplied originals to the original reading position 5 on the platen 4 and to feed read originals from the original reading position 5, and a discharge portion to discharge originals after reading.

As shown in FIG. 1 and FIG. 2, the aforementioned original sheet feeding portion is provided a sheet supply tray 2 for stacking originals, a pickup roller 6 that touches the upper most surface of originals stacked on the sheet supply tray 2 to draw out the uppermost original, and the sheet feeding roller 7 and separation roller 8 for separating originals drawn out by the pickup roller 6 and supplying them one at a time. The aforementioned pickup roller 6 is swingingly interlocked to the sheet feeding roller 7 by the interlocking arm 9, and both reversingly rotate via a one-way clutch that can rotate in only one direction. The aforementioned separation roller 8 resiliently separates with the sheet feeding roller 7 by the spring member 10 that presses upward from below. To the separation roller 8 is established the torque limiter. When two or more originals pass between the sheet feeding roller 7 and separation roller 8, the torque limiter activates to fix the separation roller 8, and after originals are separated into a single sheet, the separated sheet rotatingly follows the sheet feeding roller 7.

The aforementioned sheet supply tray 2 is obliquely established downward toward the sheet supply side and is covered by an upwardly opening cover 15. Also, the aforementioned pickup roller 6 and sheet feeding roller 7 are arranged in the recess portion 16 established in the lower central area of the cover 15. Also, to the sheet feeding roller 7 is arranged the guide plate 11 that slides in the original width direction. This guide plate 11 regulates the positions of the originals in the width direction, so side guides 12 are established on both sides to regulate both sides of the originals. According to this embodiment, the side guides 12 extend to the front along the sides of the guide plates 11, the leading edge reaching near the sheet supply entrance 13 downstream of the pickup roller 6. Also, to the bottom of the leading edge of the side guide 12 is formed the guide protrusion 12*a*. The guide protrusion 12*a* slides along the guide groove 12 established in the upper surface of the sheet supply tray 2. Still further, to the top edge of the side guide 12 is disposed the top surface regulating guide 14 that regulates the top surface of the originals. The top surface regulating guide 14 is formed protruding horizontally toward the inside from the upper edge of the side guide. From substantially centrally located on the side guide 12 is a slight curve that continuously extends to the original draw out position by the pickup roller 6.

As described above, because the side guides 12 extend downstream to the pickup roller 6, both sides of the originals are regulated until just prior to being nipped by the sheet feeding roller 7. Particularly, because the leading edge of the side guide 12 is restricted by the guide groove 19, the side guide 12 positions substantially straight along the original supply direction from the leading edge to the trailing edge while it slides in the left and right directions, thereby securely regulating each side of the originals. Furthermore, by establishing the top surface regulating guides 14 at the original draw out position, the top surface regulating guides 14 ensure the original supply entrance 13 and regulate both sides of the curled originals from sliding upward. Because neither side of the originals moves out from the guide surface of the side guide 12, skewing in the originals is suppressed.

Still further, according to the present embodiment, as shown in FIG. 1 and FIG. 2, the original surface pressing guide 17 is established between the pickup roller 6 and the sheet feeding roller 7. This pressing guide 17 is composed of the guide ribs and the leading edges thereof protrude from the bottom of the cover 15. To the bottom portions of the guide ribs are formed the oblique guide surfaces 18 toward the pickup roller 6 side. The original surface pressing guide 17, as shown in FIG. 3, guides the originals to the sheet feeding roller 7 by their leading edge touching the guide surface 18 on the original surface pressing guide 17 even when the leading edges of the originals drawn out by the pickup roller 6 are curled upward. Also, the trailing edge of the originals are securely transported in a stable manner by their touching the guide surface 18 on the original surface pressing guide 17, even when passing through the nipping point of the sheet feeding roller 7 and separation roller 8. Particularly, for transporting sturdy originals, such as thick originals, this holds down the trailing edges of originals that rebound, to securely hold down the bouncing trailing edge of originals.

To the downstream side of the aforementioned sheet feeding roller 7 in the aforementioned transport portion is established a transport path for transporting supplied originals to the original reading position 5 (specifically, the position for reading originals as they are passed over the platen by the optical reading means arranged below the platen) established at the image reading apparatus platen 4. The transport path is provided the transport path 20 for inverting originals while curving them and for transporting them to the original reading position 5, and the discharge path 21 for transporting originals that pass through the original reading position 5.

The aforementioned transport path 20, as shown in FIG. 5, is formed by the outer guide plate 22 and the inner guide plate 23 curvingly formed toward the inside of the apparatus to guide originals from the sheet feeding roller 7 to the transport rollers 24 and 25 arranged upstream of the aforementioned platen 4. Also, the transport path 20 is provided the first transport path 23*a* for guiding the original P in the substantial straight direction S of the nipping point 32 of the aforementioned sheet feeding roller 7 and the separation roller 8, and the second transport paths 23*b* and 23*c* extending downstream of the first transport path 23*a* for guiding the originals P transported from the aforementioned first transport path 23*a* from the aforementioned substantial straight direction S to the transport rollers 24 and 25 after curving on the separation roller 8 side. Near the downstream side of the nipping point 32 of the aforementioned sheet feeding roller 7 and separation roller 8 is established the first curved portion 30 at a position shifting from the first transport path 23*a* to the second transport path 23*b*, to the first curved portion 30 is established the follower roller 26 that rotates (following the originals) while touching the original P at substantially the same height (on straight line S of the nipping point 32) as the nipping point 32, protruding into the transport path 20 from the inner guide plate 23 side. To substantially the central position on the aforementioned second transport paths 23*b* and 23*c* is established the second curved portion 31 that further curves the original P being transported into the inner side of the transport path 20. Also to the second curved portion 31 is established the second follower roller 27, which is substantially the same as the one described above, protruding slightly from the inner side guide 23 into the transport path 20. Also, the transport rollers 24 and 25 are established downstream of the sheet feeding roller 7 further on the separation roller 8 side than the sheet feeding roller 7.

The degree of curve of the aforementioned first curved portion 30 and the second curved portion 31 is a design item that is selectable for each apparatus, but in view of making the length of the transport path of the overall apparatus as short as possible, it is advantageous for a large degree of curve. Also, in shortening the length of the first transport path 23*a*, the position of the aforementioned first curved portion 30 is preferable to be as close downstream from the nipping point 32 of the sheet feeding roller 7 and separation roller 8 as possible. In this way, by establishing the first curved portion 30 near the downstream side of the nipping point 32 and the follower roller 26 at the first curved portion 30, the original P can be transported between the nipping point 32 and the first follower roller 26 without touching the inner side guide plate 23. For example, if the leading edge of the original P is curled when transporting thin originals, it can be passed from the nipping point 32 directly to the first follower roller 26, the leading edge of the original P is curved by touching the inner side guide plate 23, and after being transported while it is curved, it can alleviate any transporting problems by being nipped by the transport rollers 24 and 25. Note that immediately downstream of the aforementioned transport rollers 24 and 25 is established the guide portion 28 that guides the original P to the top of the platen 4.

Therefore, as shown in FIG. 5, the original P separated into a single sheet between the sheet feeding roller 7 and separation roller 8 is sent into the first transport path 23*a* and the second transport paths 23*b* and 23*c* by the sheet feeding roller 7, and is further transported to the top of the platen 4 after being nipped by the transport rollers 24 and 25, however, when transporting by the transport rollers 24 and 25, the original P upstream of the transport path 20 is still nipped by the sheet feeding roller 7 and the separation roller 8. For that reason, the original P in transport develops transport resistance force in the downward direction, particularly increasing in two locations of curved portion 30 and curved portion 31. However, the first curved portion 30 is positioned at the tangential direction S on the aforementioned nipping point 32, so the first follower roller 26 receives the transport resistance force from the original P at the first curved portion 30 and that force does not become directly applied to the downward direction on the separation roller 8 (the direction opposite of the pressing direction toward the sheet feeding roller 7). The result is to vary the pressing force on the separation roller 8 to prevent the separation roller 8 from separating from the sheet feeding roller 7. Also, to the aforementioned two curved portions of 30 and 31 are arranged both the follower rollers of 26 and 27, so contact friction at the aforementioned curved portions of 30 and 31 is alleviated, the transport load on the original P is lightened and while reducing scraping on the original surface, skewing is prevented while transporting the original.

According to this embodiment, the positional relationships of the follower rollers 26 and 27 and the transport roller 24 with regard to the aforementioned sheet feeding roller 7 is shown in FIG. 6. In other words, each of the sheet feeding roller 7 and the first follower roller 26 is composed of a single roller, and the second follower roller 27 and the transport rollers 24 are composed of 3 rollers each lined up in the originals width direction. The second follower roller 27 compared to the left and right rollers 27*a* and 27*c* is formed with the central roller 27*b* longer in the width direction, the first follower roller 26 being substantially the same length. Also, the three transport rollers of 24*a*, 24*b* and 24*c* are all the same shape. According to this embodiment, the first follower roller 26, the centrally positioned second follower roller 27*b* and the transport roller 24*b* are positioned centrally on a straight line T extending in the transport direction of the original from the centrally positioned 7*a* of the sheet feeding roller 7, and with the centrally positioned 7*a* of the sheet feeding roller 7 as the apex, on the sides H1 and H2 forming a triangle with the apex and the left and right transport rollers 24*a* and 24*b* are positioned the aforementioned first follower roller 26 and the left and right second follower rollers 27*a* and 27*b*. Note that regarding the transport rollers 25 on the one side, though not shown in the drawings, it opposes the aforementioned transport rollers 24 so an explain shall herewith be omitted.

When the original is pulled from the sheet feeding roller 7 by the aforementioned transport rollers 24 and 25, the largest load is applied on the original in the direct line T in the original transport direction from the aforementioned sheet feeding roller 7. For that reason, as described above, by positioning the first follower roller 26 and the second follower roller 27*b* that alleviate the transport resistance force in the direct line T that links the centrally positioned 7*a* and the transport rollers 24*b* on the sheet feeding roller 7, it effectively alleviates the load applied to the originals and effectively prevents skews in the originals. Also, by transporting the originals by the left and right transport rollers 24*a* and 24*c* arranged in the original width direction, the load applied to the originals is even further alleviated by arranging the aforementioned first follower roller 26 and the second follower rollers 27*a* and 27*b* on the sides H1 and H2 forming the aforementioned triangle applied thereto with transport resistance force.

On the one side, the discharge path 21, as is shown in FIG. 1 and FIG. 5, is formed in substantially a straight line by the uppers side plate 40 and the lower side guide plate 41 that are obliquely arranged upward from the downstream edge of the platen 4, and to the downstream side are arranged the paired discharge rollers 43 and 44 to transport originals that pass the original reading position 5 into the discharge tray 42. Also, to immediately downstream of the platen 40 is arranged the lifting guide member 45 that lifts by curving the originals read at the original reading position 5 on the platen 4 and guides them into the discharge path 21. As shown in FIG. 5, to the lifting guide member 45 is formed the oblique guide surface 46 that links from the downstream side of the platen 4 to the aforementioned lower guide plate 41 to guide originals along the guide surface 46.

In this way, a curved path from the transport rollers 24 and 25 leading all the way to the draw-out rollers 43 and 44, via the aforementioned platen 4, is formed and to the curved portion regulated by the aforementioned platen 4 and the lifting guide member 45 is established a film member for pressing transported originals toward the upper surface of the platen 4 and the lifting guide member 45.

The film member, as can be seen in FIG. 5 and FIG. 7, is configured by a Mylar sheet 51 extending from the upstream of the original reading position 5 on the aforementioned platen 4 part-way to the discharge path 21 along the guide surface 46 on the lifting guide member 45. The Mylar sheet 51 is a polyester film with a thickness of approximately 0.1 mm. The upstream edge thereof is fixed to the frame portion 53 on the regulating member 52, which is described later, while the downstream edge is follower. It extends along the oblique surface 46 of the lifting guide member 45 part-way into the discharge path 21, and touches the lower guide plate 41. The aforementioned Mylar sheet 51 can be configured to press a portion of the width direction of originals being transported, but as shown in FIG. 7, it is preferable that it be configured over the enter width to press the entire original. Specifically, it is preferable to be configured to be wider than the maximum size of originals that are processed on the original sheet feeding apparatus.

On the one side, the aforementioned Mylar sheet 51 is restricted in movement upward by the regulating member 52, as shown in FIG. 7. The regulating member 52 is provided the plate shaped portion 54 having substantially a rectangular shape that covers the Mylar sheet 51 from above, the frame portion 53 that adhesively mounts the aforementioned Mylar sheet 51, the regulating surface 58 formed on the opposing edge of the frame portion 53 and that extends in the original width direction and the positioning protrusion 55 that protrudes from both edges of the regulating surface 58 into the lifting guide member 45 side, and the vertical wall portion 56 rising up from both the right and left sides of the plate shaped portion 54 is pivotably supported on the original sheet feeding apparatus. The regulating surface 58 of the regulating member 52 is springingly urged to the platen 4 side by a spring member 57 arranged therebetween with the original sheet feeding apparatus. Also, using the springing urging force, described above, on the regulating member 52, the aforementioned positioning protrusion 55 touches a portion of the guide surface 46 in the lifting guide member 45, thereby positioning the regulating surface 58 in a position straddling from the guide surface 46 with a determined gap S, the Mylar sheet 51 being inserted to the determined gap S.

Therefore, when lifting the originals in the curved portion of the lifting guide member 45 downstream of the platen 4, or while transporting originals to the discharge path 21, even with the action of the force of the original pushing the Mylar sheet 51 upward, the regulating member 52 holds the Mylar sheet 51 from upward movement, so that the Mylar sheet 51 does not move upward. Also, because the original is transported. while the Mylar sheet 51 is pushing it downward, it is possible to transport the original along the guide surface 46 of the lifting guide member 45 to smoothly guide the original into the discharge path 21.

The following shall describe the actions of the original sheet feeding apparatus 1 according to the above configuration. As shown in FIG. 1 and FIG. 2, originals are stacked on the sheet supply tray 2 and both sides thereof are regulated with the side guides 12 by sliding the guide plates 11 left and right. When the originals on the sheet supply tray 2 are detected by the empty sensor, the drive motor is driven forward, the pickup roller 6 firmly pushes the upper most surface of the original to draw out the uppermost original. Drawn out originals are fed to the sheet supply entrance 13 by the sheet feeding roller 7, but if the original P has a slight curl, the pickup roller 6 presses the central portion of the original 2, as shown in FIG. 4, to draw it and both side portions of the original P float accordingly. However, the top surface regulating guides 14 that regulate the top surface of the original P regulate the curling up of the original P at the original draw out position, so the edges do not come out from the guide surfaces of the side guides 12. In this way, the original P is led into the sheet supply entrance while being regulated by both the side guides 12 and the top surface regulating guides 14 and is nipped by the sheet feeding roller 7 and the separation roller 8. Even if the leading edge of the original P drawn out by the pickup roller 6 curl upward, as shown in FIG. 3, the original is guided to the nipping position of the sheet feeding roller 7 and the separation roller 8 while touching the guide surface 18 on the original surface pressing guide 17. The original is securely separated into a single sheet by the sheet feeding roller 7 that is rotating in the same direction as the pickup roller 6 and the separation roller 8 that resiliently presses from below, and is guided into the transport path 20 while the separation roller 8 rotatingly follows the sheet feeding roller 7.

As shown in FIG. 5, when the leading edge of the original P fed into the transport path 20 is nipped by the transport rollers 24 and 25, the rotation of the sheet feeding roller 7 and the pickup roller 6 stop and the original is send by the transporting force of the transport rollers 24 and 25. At this time, the original P is nipped by the sheet feeding roller 7 and the separation roller 8, and is being pulled from the aforementioned nipping point 32 so there is an enormous load being applied to the original P particularly at the two curve portions of 30 and 31. However, as described above, because the first follower roller 26 is arranged at the first curved portion 30 immediately downstream of the sheet feeding roller 7, the original P can be smoothly transported with the load alleviated at the aforementioned curved portion 30. Also, the pressing force of the separation roller 8 varies because there is no downward pulling force generated at the separation roller 8. Furthermore, because at the first follower roller 31 is arranged the second follower roller 27, at the first curved portion 31 the original P can be smoothly transported by the transport rollers 24 and 25 with the load alleviated to the original P. Additionally, because the first curved portion 30 is established immediately downstream of the sheet feeding roller 7, the first transport path 23*a* is shorter.

Originals traveling over the second transport path 20 by the aforementioned transport rollers 24 and 25 are guided by the guide portion 28 and Mylar sheet 51 positioned immediately downstream of the transport rollers 24 and 25 and are fed into the original reading position 5 on the top of the platen 4. Then, originals that have been read there are guided into the discharge path 21 as they are and are pushed by the Mylar sheet 51 and pressingly lifted by the guide surface 46 on the lifting guide member 45 and transported into the discharge tray 42 by the draw-out rollers 43 and 44.

Figure 8:
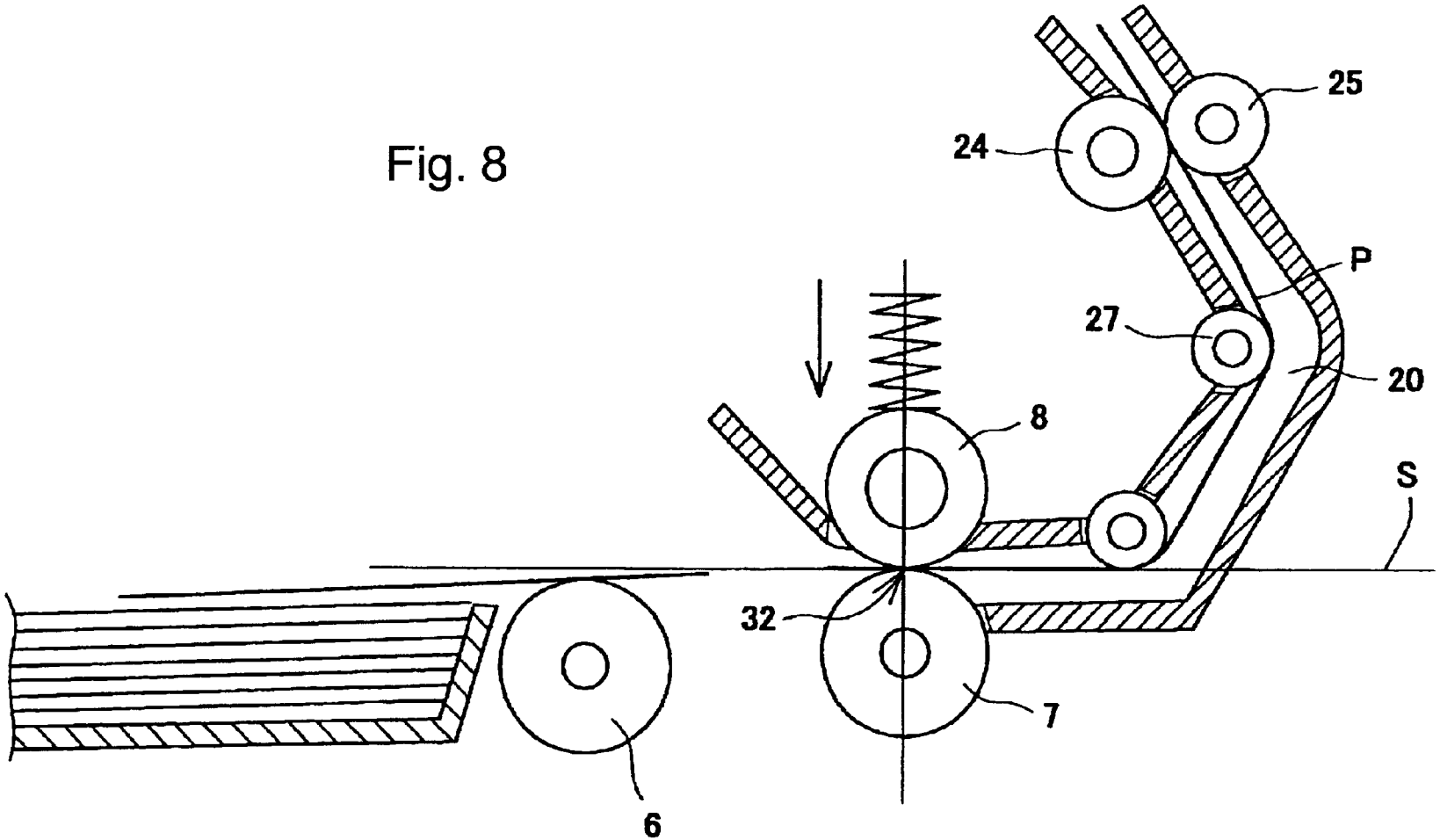
FIG. 8 is a sectional view of a variation of the embodiment according to the present invention.

Note that according to the aforementioned embodiment, an original sheet feeding apparatus was explained that is provided a transport path curved downward from the sheet feeding roller 7, but as shown in FIG. 8, this invention is provided with a transport path 20 that curves upward from the sheet feeding roller 7, and the transport rollers 24 and 25 that are arranged closer to the separation roller 8 than the sheet feeding roller 7, but it can also include an original sheet feeding apparatus that separates originals drawn by the pickup roller 6 by the separation roller 8 pressing the sheet feeding roller 7 upward (see the arrow in the drawing) and can apply to an original sheet feeding apparatus equipped with a curved portion in the transport path to invert or turn over originals. Also, while the aforementioned transport rollers 24 and 25 can also be applied to an original sheet feeding apparatus to dual as a resist mechanism, this invention can also be applied to many sheet feeding apparatus that feed normal sheets, not originals of a printer apparatus. Furthermore, in the aforementioned embodiment, follower rollers established in the first curved portion receive the transport resistance force so while preventing variations of the separation roller pressing force, they alleviate the transport resistance force in the first curved portion. However, it is also acceptable to establish follower rollers at substantially the same height as the nipping point in the first transport path extending in the tangential direction of the nipping point to touch the original thereby receiving the transport resistance and thus preventing variations in the pressing force of the separation roller.

Figure 9:
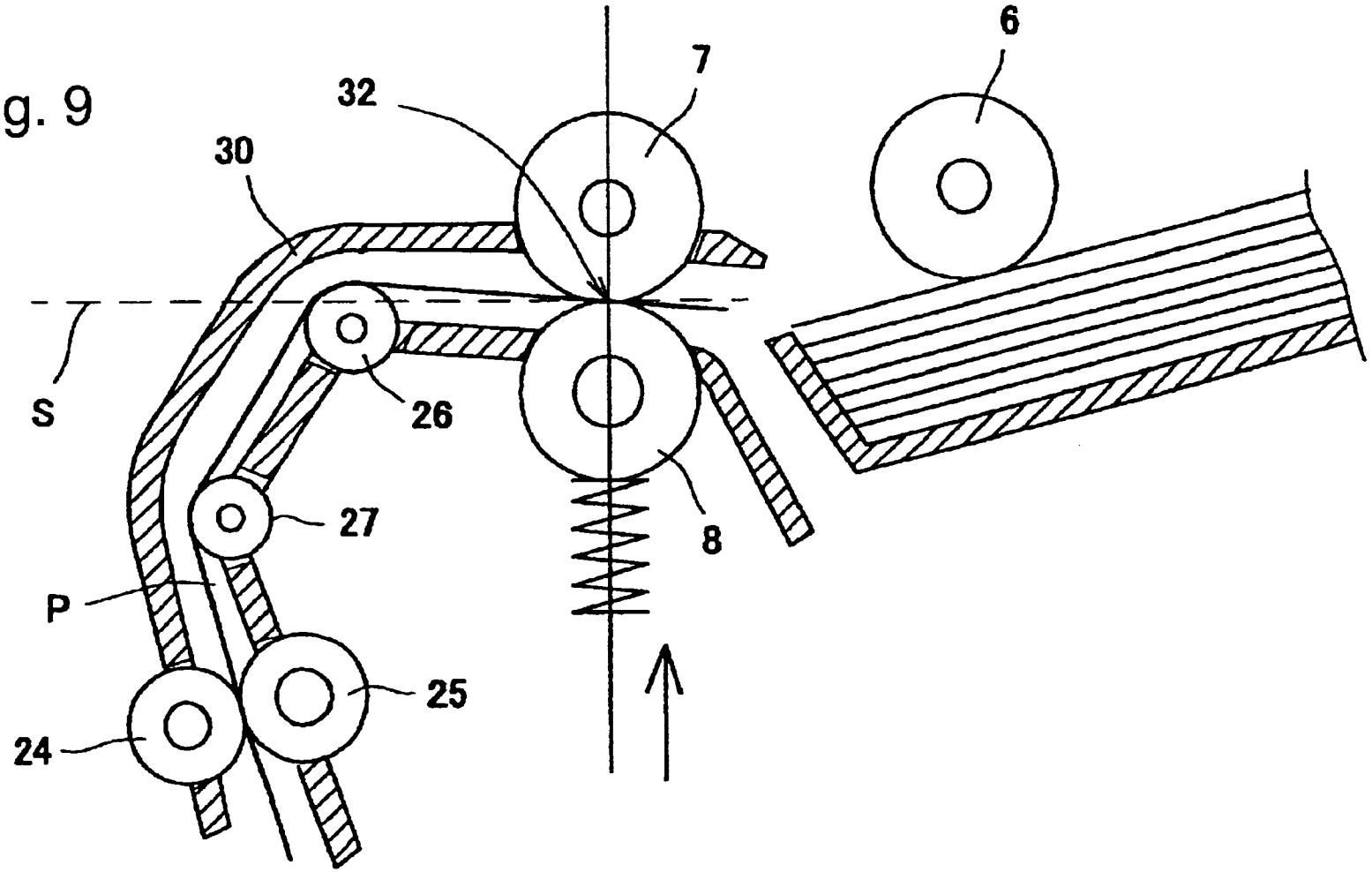
FIG. 9 is a sectional view of a variation of the embodiment according to the present invention.

Also, as shown in FIG. 9, it is perfectly acceptable to arrange the follower roller 26 to touch the originals on the sheet feeding roller 7 on the straight line S of the nipping point 32 of the sheet feeding roller 7 and separation roller 8, however in such cases, in the same way as was described for the present embodiment, the first follower roller 26 receives the force reverse of the pressing direction (the direction of the arrow in the FIG.) of the separation roller 8 by the transport rollers 24 and 25 so the pressing force of the separation roller 8 varies and prevents the separation roller 8 from separating from the sheet feeding roller 7.

Figure 10:
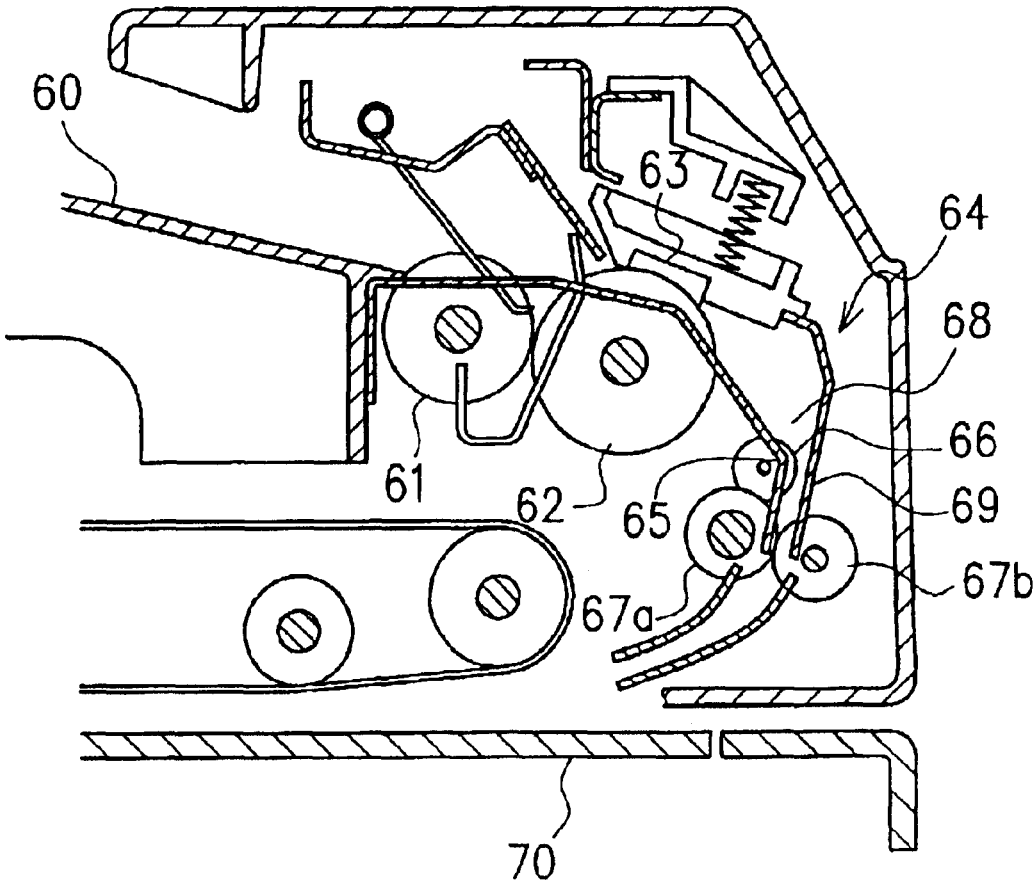
Fig. 10 Prior Art
FIG. 10 is a view showing an internal configuration of an example of an original supply apparatus of the prior art.

Also, with the present embodiment, rotatable separating rollers were employed for the separating means, but it is also perfectly acceptable to use a fixed pad, as shown in FIG. 10.

While the invention has been explained with reference to the specific embodiments of the invention, the explanation is illustrative and the invention is limited only by the appended claims.

What is claimed is:

1. A sheet feeding apparatus comprising:

sheet feeding means for feeding sheets drawn from a sheet supply tray;

separating means separatably pressing said sheet feeding means, for separating the sheets drawn from a sheet supply tray together with the sheet feeding means;

a transport path for transporting the sheets fed by the sheet feeding means downstream and having a first transport path for guiding sheets fed from said sheet feeding means in a substantial tangential direction of a nipping point of said sheet feeding means and said separating means, and a second transport path bent toward a separating means side in a direction close to the separating means at a curved portion relative to the first transport path for guiding the sheets from said first transport path;

transport means formed in the second transport path for transporting the sheets nipped by said sheet feeding means and said separating means downstream; and a follower rotating body protruding from said separating means side into said transport path between said nipping point and the curved portion extending from said first transport path to said second transport path.

2. The sheet feeding apparatus according to claim 1, further comprising a second curved portion formed in said second transport path and a second follower rotating body protruding from an inner side of said second curved portion into said transport path.

3. The sheet feeding apparatus according to claim 1, wherein said sheet feeding means, said follower rotating bodies and said transport means are composed of at least one roller, respectively, and at least one follower roller and one transport roller are arranged in a direct line along a direction of sheet transport in a substantial center of a width direction of a sheet feeding roller.

4. The sheet feeding apparatus according to claim 3, wherein the substantial center of the width direction of said sheet feeding roller is used as an apex of a triangle shape, follower rotating bodies are arranged on two sides of the triangle shape tying the apex and two ends of a width direction of transport rollers.

5. The sheet feeding apparatus according to claim 1, wherein said follower rotating body receives a force from the sheet pulled by the transport means, said force being applied in a direction to separate the separating means from the sheet feeding means.

6. A sheet feeding apparatus comprising:

sheet feeding means for feeding sheets drawn from a sheet supply tray;

separating means separatingly pressing said sheet feeding means, for separating the sheets drawn from a sheet supply tray together with the sheet feeding means;

a transport path for transporting the sheets fed by the sheet feeding means downstream and having a first transport path for guiding the sheets fed from said sheet feeding means in a substantial tangential direction of a nipping point of said sheet feeding means and said separating means, and a second transport path bent toward a separating means side in a direction close to the separating means at a curved portion relative to the first transport path for guiding sheets from said first transport path;

transport means formed in the second transport path for transporting while inverting the sheets nipped by said sheet feeding means and said separating means downstream; and a follower rotating body protruding from an inner side of a curved portion extending from said first transport path to said second transport path, into said transport path.

7. The sheet feeding apparatus according to claim 6, further comprising a second curved portion formed in said second transport path and a second follower rotating body protruding from an inner side of said second curved portion into said transport path.

8. The sheet feeding apparatus according to claim 6, wherein said sheet feeding means, said follower rotating bodies and said transport means are composed of at least one roller, respectively, and at least one follower roller and one transport roller are arranged in a direct line along a direction of sheet transport in a substantial center of a width direction of a sheet feeding roller.

9. The sheet feeding apparatus according to claim 8, wherein the substantial center of the width direction of the aforementioned sheet feeding roller is used as an apex of a triangle shape, follower rollers being arranged on two sides of the triangle shape tying the apex and two ends of a width direction of transport rollers.

10. The sheet feeding apparatus according to claim 6, wherein said follower rotating body receives a force from the sheet pulled by the transport means, said force being applied in a direction to separate the separating means from the sheet feeding means.

* * * * *